US008695333B2

(12) United States Patent
Vigholm et al.

(10) Patent No.: US 8,695,333 B2
(45) Date of Patent: Apr. 15, 2014

(54) METHOD FOR WHEN NECESSARY AUTOMATICALLY LIMITING A PRESSURE IN A HYDRAULIC SYSTEM DURING OPERATION

(75) Inventors: Bo Vigholm, Stora Sundby (SE); Andreas Ekvall, Hallstahammar (SE)

(73) Assignee: Volvo Construction Equipment AB, Eskilstuna (SE)

( * ) Notice: Subject to any disclaimer, the term of this patent is extended or adjusted under 35 U.S.C. 154(b) by 917 days.

(21) Appl. No.: 12/744,490

(22) PCT Filed: Dec. 12, 2007

(86) PCT No.: PCT/SE2007/001103

§ 371 (c)(1),
(2), (4) Date: May 25, 2010

(87) PCT Pub. No.: WO2009/075613

PCT Pub. Date: Jun. 18, 2009

(65) Prior Publication Data

US 2010/0263735 A1 Oct. 21, 2010

(51) Int. Cl.
*F16D 31/02* (2006.01)
*F15B 13/04* (2006.01)

(52) U.S. Cl.
USPC ..... 60/461; 91/465

(58) Field of Classification Search
USPC ..... 91/358 R, 403, 404, 465; 60/459, 461
See application file for complete search history.

(56) References Cited

U.S. PATENT DOCUMENTS

| | | | | |
|---|---|---|---|---|
| 5,138,838 | A * | 8/1992 | Crosser | 91/465 |
| 5,813,226 | A * | 9/1998 | Krone et al. | 60/327 |
| 6,199,378 | B1 | 3/2001 | Aardema et al. | |
| 2004/0182231 | A1 * | 9/2004 | Yo et al. | 91/361 |
| 2006/0218912 | A1 * | 10/2006 | Price et al. | 60/459 |
| 2007/0044650 | A1 | 3/2007 | Kuehn et al. | |

FOREIGN PATENT DOCUMENTS

| | | | |
|---|---|---|---|
| GB | 2298291 | A | 8/1996 |
| GB | 2406363 | A | 3/2005 |
| WO | 9214944 | A1 | 9/1992 |

* cited by examiner

*Primary Examiner* — Michael Leslie
(74) *Attorney, Agent, or Firm* — WRB-IP LLP

(57) ABSTRACT

A method is provided for, when necessary, automatically limiting a pressure in a hydraulic system during operation. A system is arranged to deliver pressurized hydraulic fluid to at least one fluid actuated device arranged to perform a work function, where the procedure includes sensing a pressure in at least one position of the system, comparing the detected pressure value, or an associated value, with a first predefined pressure limit, and opening a communication of fluid between the fluid actuated device and a reservoir through a first conduit if the sensed pressure value, or an associated value, exceeds the predefined limit.

23 Claims, 2 Drawing Sheets

METHOD FOR WHEN NECESSARY AUTOMATICALLY LIMITING A PRESSURE IN A HYDRAULIC SYSTEM DURING OPERATION

BACKGROUND AND SUMMARY

The present invention relates to a method for automatically limiting a pressure generated during operation in a hydraulic system when needed, said system being adapted to deliver a pressurized hydraulic fluid to at least one actuator adapted to perform a work function.

Below, the invention will be described in connection with a working machine in the form of a wheel loader. This is a preferred, but by no means limiting application of the invention. The invention can for example also be used for other types of working machines (or work vehicles), such as a backhoe loader, an excavator, or an agricultural machine such as a tractor.

A wheel loader can be utilised for a number of fields of activity, such as lifting and transportation of rock and gravel, loading pallets and logs. In each of these activities, different equipment is used, including implements in the form of a bucket, a fork implement and gripping arms. More particularly, the equipment comprises a load-arm unit, or boom, which is pivotally arranged relative to the wheel loader frame. Two actuators in the form of hydraulic cylinders are arranged between the frame and the load-arm unit in order to achieve a lifting and lowering movement of the load-arm unit. The implement is pivotally arranged on the load-arm unit. An additional actuator in the form of a hydraulic cylinder is arranged between the implement and the load-arm unit in order to achieve a tilting movement of the implement.

The hydraulic system comprises a pump adapted to supply the hydraulic cylinders with pressurized hydraulic fluid via a hydraulic circuit comprising a plurality of control valves.

As a rule, a wheel loader has more hydraulic functions than the above-mentioned lift and tilt function. Such additional hydraulic functions include steering, 3rd, 4th, and in some cases even more functions. Each function generally needs two shock valves, except lift which has one shock valve. For a machine with a 3rd and a 4th function, this implies nine shock valves.

Different functions require different flow rates. Furthermore, the same function requires different flow rates for piston and piston rod side. Machines of different sizes also have different flow rate requirements. In practice, only a few shock valves are used, where the one having the highest flow requirement decides the flow rate. This implies that most functions have unnecessarily large shock valves.

It is desirable to achieve a method which creates prerequisites for a more cost efficient system with maintained or improved service life.

A method according to an aspect of the present invention includes detecting a pressure in at least one position in the system;—comparing the detected pressure value, or a value associated with the detected pressure value, with a first predetermined limit value; and opening a flow communication between the actuator and a tank via a first conduit if the detected pressure value, or the value associated with the detected pressure value, exceeds the predetermined limit value.

Thus, in this way, drainage to tank is actively controlled when needed. Preferably, at least one pressure sensor is adapted to detect the pressure to the respective function.

In this way, the limit value (for example the opening pressure) can be set as low as possible in all situations, which results in a smaller load on the constituent components.

According to a preferred embodiment, the flow communication is opened via a control valve being arranged on the first conduit and having the function to control the supply of the hydraulic fluid to and from, respectively, the actuator with the object of performing the work function. In case of an unexpected pressure increase, this control valve functions as a controlled shock valve. Preferably, separate inlet and outlet valves to the actuator are provided in order to control the function (for example a lifting and lowering movement).

According to another preferred embodiment, the method further comprises the step of opening a flow communication between the actuator and the tank via a second conduit via a shock valve. The shock valve is also called pressure limiting valve. The shock valve is preferably arranged in a conventional way as a passive (directly controlled by the pressure), for example spring-loaded, shock valve. By means of combining the opening of the control valve and the shock valve, drainage to tank at a desired rate can be obtained in case of a pressure shock.

Owing to the smaller size of the possibly included directly controlled shock valves and to fewer variants, a lower cost can be achieved. Furthermore, owing to the smaller directly controlled shock valves, the valve housing can be made smaller.

As a rule, the control valve opens more slowly than the shock valve, which in many cases implies that said flow communication between the actuator and the tank via the first conduit is opened after the shock valve has opened the flow communication between the actuator and the tank via the second conduit. In other words, the control valve is opened with a certain delay, so that the shock valve is opened first. It is possible, however, to ensure that the control valve opens substantially simultaneously as, or before the shock valve.

Preferably, a shock valve of a smaller size, i.e. with a lower nominal flow rate, than the electrically controlled outlet valve is used. The directly controlled shock valve, which is fast-acting, opens directly and flow drainage is initiated. Then, the electrically controlled control valve, which is capable of handling the larger flow requirement and draining it to tank, is opened.

According to another preferred embodiment, the method comprises the step of determining the flow rate to the tank on the basis of the detected pressure. In this way, the characteristics of the shock control function can be determined. The opening degree of the control valve is controlled, for example, on the basis of the pressure change in the actuator.

Further preferred embodiments of the invention and advantages associated therewith are apparent from the remaining claims and the following description.

BRIEF DESCRIPTION OF FIGURES

The invention will be described more closely in the following, with reference to the embodiments shown in the attached drawings, wherein.

DETAILED DESCRIPTION

Figure 1:
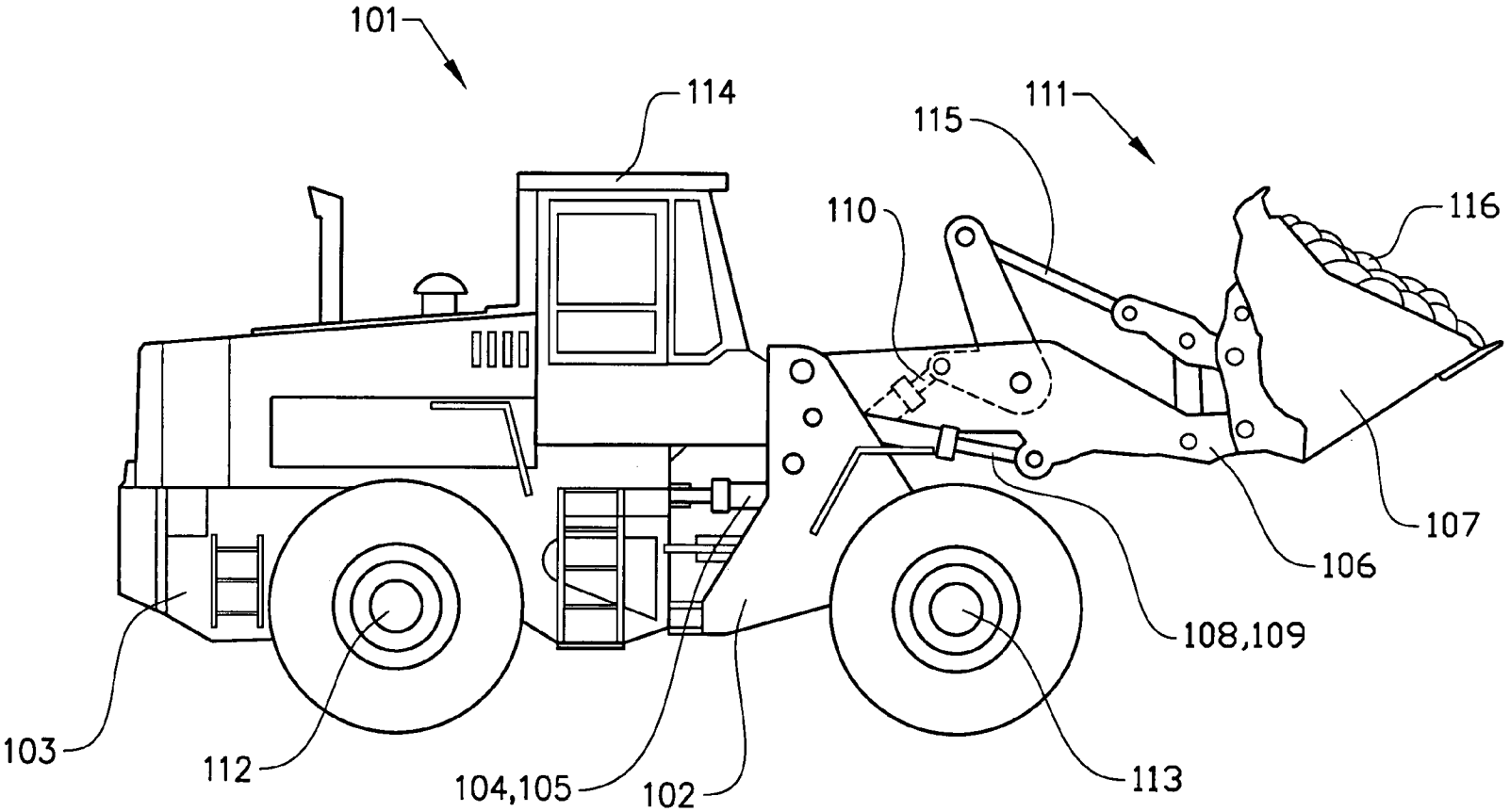
FIG. 1 shows a side view of a wheel loader.

FIG. 1 shows a side view of a wheel loader 101. The wheel loader 101 comprises a front vehicle section 102 and a rear vehicle section 103, said sections each comprising a frame and a pair of drive shafts 112, 113. The rear vehicle section 103 comprises a driver's cab 114. The vehicle sections 102, 103 are connected to each other in such a way that they can be pivoted relative to each other about a vertical axis by means of two actuators in the form of hydraulic cylinders 104, 105 which are connected to the two sections. Accordingly, the hydraulic cylinders 104, 105 are disposed on different sides of a centre line in the longitudinal direction of the vehicle for steering, or turning the wheel loader 101.

The wheel loader 101 comprises an equipment 111 for handling objects or material. The equipment 111 comprises a load-arm unit 106 and an implement 107 in the form of a bucket which is fitted on the load-arm unit. Here, the bucket 107 is filled with material 116. A first end of the load-arm unit 106 is pivotally connected to the front vehicle section 102 in order to achieve a lifting movement of the bucket. The bucket 107 is pivotally connected to a second end of the load-arm unit 106 in order to achieve a tilting movement of the bucket.

The load-arm unit 106 can be raised and lowered relative to the front section 102 of the vehicle by means of two actuators in the form of hydraulic cylinders 108, 109, each of which is connected at one end to the front vehicle section 102 and at the other end to the load-arm unit 106. The bucket 107 can be tilted relative to the load-arm unit 106 by means of a third actuator (hydraulic cylinder) 110, which is connected at one end to the front vehicle section 102 and at the other end to the bucket 107 via a link arm system.

Figure 2:
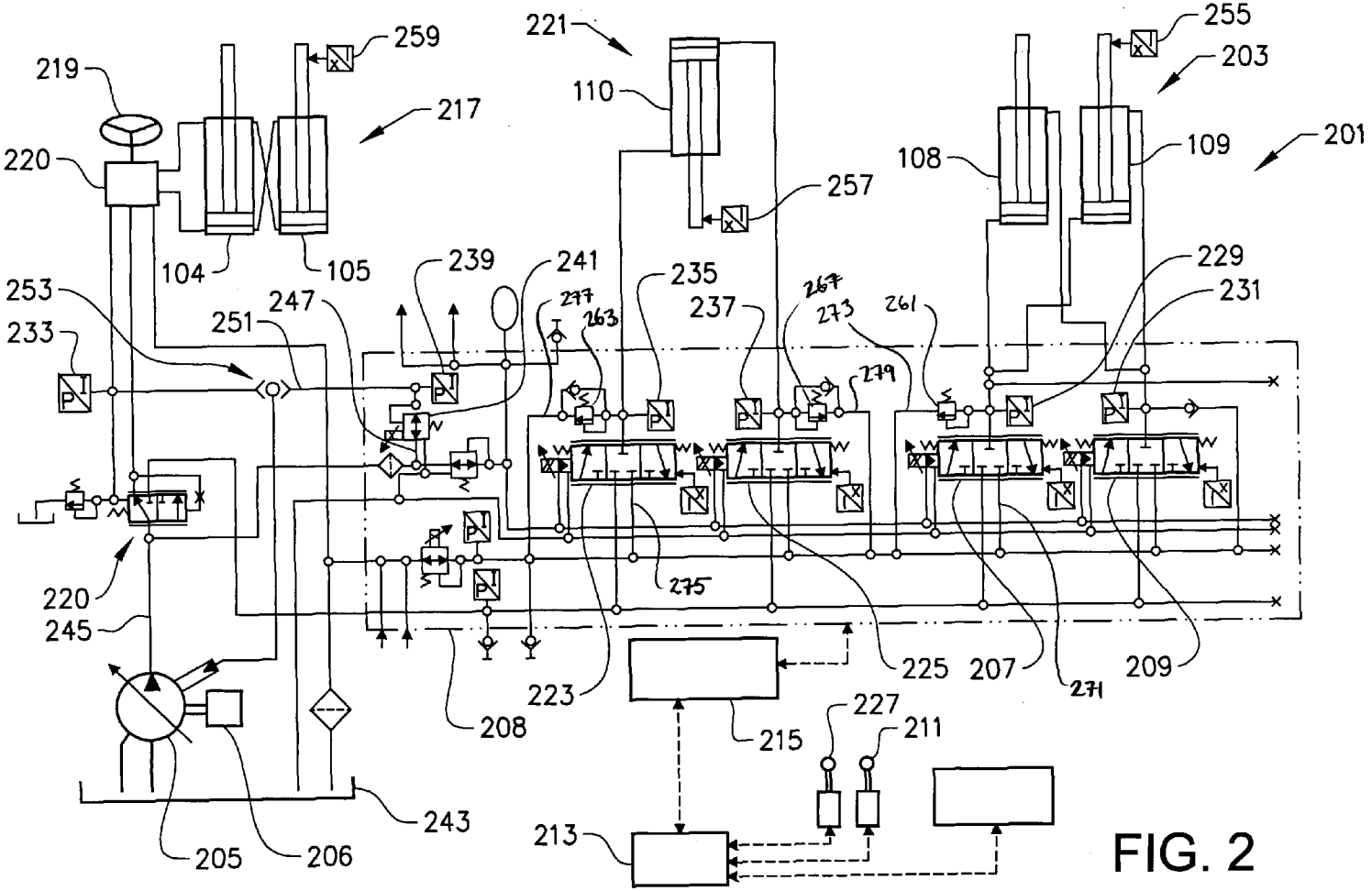
FIG. 2 shows a system for performing the method during operation of the wheel loader.

A first embodiment of the system is shown in FIG. 2. The system 201 comprises a pump 205 adapted to supply the hydraulic cylinders with pressurized hydraulic fluid via a hydraulic circuit. The pump 205 is driven by the vehicle's propulsion engine 206, in the form of a diesel engine. The pump 205 has a variable displacement. The pump 205 is preferably adapted for infinitely variable control. The system 201 comprises a valve device 208 (se the dash-dotted line) which comprises a hydraulic circuit having a plurality of control valves for controlling the lift and tilt function.

Two control valves, in the form of flow valves, 207, 209, are arranged between the pump 205 and the lift cylinders 108, 109 in the circuit in order to control the lifting and lowering movement. While a first one of these valves 207 is arranged to connect the pump 205 to the piston side, a second one of these valves 209 is arranged to connect a tank 243 to the piston rod side. Furthermore, the first valve 207 is arranged to connect the tank 243 to the piston side and the second valve 208 is arranged, correspondingly, to connect the pump 205 to the piston rod side. This offers large possibilities for varying the control. In particular, it is not necessary to connect the pump and tank simultaneously to the function.

The system 201 further comprises a control unit 213, or computer, which contains software for controlling the functions. The control unit is also called a CPU (central processing unit) or ECM (electronic control module). The control unit 213 suitably comprises a microprocessor.

An operator-controlled element 211, in the form of a lifting lever, is operatively connected to the control unit 213. The control unit 213 is adapted to receive control signals from the control lever and to actuate the control valves 207, 209 correspondingly (via a valve control unit 215). The control unit 213 preferably controls more general control strategies and the control unit 215 controls basic functions of the valve unit 208. Naturally, the control units 213, 215 can also be integrated into a single unit. When controlling the pump 205, there is an oil flow out to the cylinders 108, 109, the level of which depends on the extent to which the actuated valves 207, 209 are opened.

An operator-controlled element 219, in the form of a steering-wheel, is hydraulically connected to the steering cylinders 104, 105, via a valve unit in the form of an orbitrol unit 220, for direct-control thereof.

Similarly as for the lift function, two control valves 223, 225 are arranged between the pump 205 and the tilt cylinder 100 for controlling the forward and return movement of the implement relative to the load-arm unit. An operator-controlled element 227, in the form of tilt lever, is operatively connected to the control unit 213. The control unit 213 is adapted to receive control signals from the tilt lever and to actuate the control valves 223, 225 correspondingly.

A prioritizing valve 220 is arranged at the outlet conduit 245 from the pump in order to automatically prioritize that the steering function receives the required pressure before the lift function (and the tilt function).

The system 201 is load-sensing and comprises, for this purpose, a plurality of pressure sensors 229, 231, 233, 235, 237 for detecting load pressures of each of said functions. The lift function of the system comprises two pressure sensors 229, 231, out which one is arranged on a conduit to the piston side of the lift cylinders and the other on a conduit to the piston rod side of the lift cylinders. In a corresponding way, the tilt function of the system comprises two pressure sensors 235, 237, out of which one is arranged on a conduit to the piston rod side of the tilt cylinder and the other on a conduit to the piston side of the tilt cylinder. The steering function comprises a pressure sensor 233 on a conduit connected to the steering cylinders 104, 105. More precisely, the pressure sensor 233 is situated on the LS-conduit which receives the same pressure as on one cylinder side when steering in one direction and as on the other cylinder side when steering in the other direction. In neutral, the LS-conduit is connected to tank.

The system further comprises an electrically controlled valve 241 adapted to control the output pressure of the pump via a hydraulic signal. The system 201 comprises an additional pressure sensor 239 for detecting a pressure which is indicative of an output pressure from the pump. More precisely, the pressure sensor 239 is adapted to detect the pressure in a position downstream the electrically controlled valve 241. Accordingly, the pressure sensor 239 senses the pump pressure directly when the valve 241 is fully open. In normal driving conditions, the pressure sensor 239 detects the output pressure from the valve 241. Accordingly, the control unit 213 is adapted to receive a signal from the pump pressure sensor 239 with information about of the pressure level.

Accordingly, the control unit 213 receives electrical signals from the pressure sensors 229, 231, 233, 235, 237, 239 and generates an electrical signal for controlling the electrical valve 241.

As previously stated, the control unit 213 is adapted to receive signals from the control levers 211, 227. When the operator wants to lift the bucket, the lift lever 211 is operated. The control unit receives a corresponding signal from the lift lever 211 and actuates the control valves 207, 209 to such a position that the pump is connected to the piston side of the lift cylinders 108, 109 and the piston rod side of the lift cylinders is connected to the tank 243. Furthermore, the control unit receives signals from the load pressure sensor 229 on the piston side of the lift cylinders and from the pressure sensor 239 downstream the pump. Based upon the received signals, a desired pump pressure at a level above the detected load pressure is determined, and the electrically controlled pump control valve 241 is actuated correspondingly.

The control unit 213 is preferably adapted to coordinate the opening degree of the control valves 207, 209 and the output pressure of the pump 205 for optimum operation.

The tilt function is controlled in a corresponding manner as the lift function. When steering the machine, the pressure sensor 233 of the steering function detects a load pressure of the steering and generates a corresponding load signal. The control unit 213 receives this load signal and a signal from the pressure sensor 239 on the outlet conduit of the electrically controlled valve 241. Based upon the received signals, a desired pump pressure at a level above the detected load pressure is determined, and the electrically controlled pump control valve 241 is actuated correspondingly.

When several functions are used simultaneously, the detected load pressures are compared and the pump 205 is controlled corresponding to the highest of the detected load pressures.

Accordingly, the electrically controlled pump control valve 241 is adapted to be infinitely adjustable between two end positions, a first end position which corresponds to the pump producing a minimum pressure and a second end position which corresponds to the pump producing a maximum pressure.

A hydraulic means 253, in the form of a reversing valve, is arranged on a conduit 251 between the electrically controlled pump control valve 241 and the pump. The reversing valve 253 is adapted to receive the hydraulic signals from the steering function and the pump control valve 241.

Furthermore, the reversing valve is adapted to control the pump 205 corresponding to the received signal having the largest load pressure. Accordingly, the hydraulic means (reversing valve) 253 selects the higher pressure in an output signal made up of two input pressure signals.

The system further comprises a sensor 255 for detecting lift cylinder position. The sensor 255 is operatively connected to the control unit 213. In this way, the control unit 213 can decide whether a lifting or lowering movement of the load is performed.

The system 201 further comprises a number of shock valves 261, 263, 367, for the lift function and the tilt function, for draining hydraulic fluid to the tank 243 in case of a strong pressure increase. The lift function of the system comprises a shock valve 261 which is arranged on a conduit 273 to the piston side of the lift cylinders. The tilt function of the system comprises two shock valves 263, 267, out of which one 263 is arranged on a conduit 277 to the piston rod side of the tilt cylinder and the other 267 on a conduit 279 to the piston side of the tilt cylinder.

Below, a method for automatically limiting a pressure generated during operation in the system when needed is described in a few different examples. The method is described with respect to the lift function, but the corresponding also applies to, for example, the tilt function.

An external force initiates a movement of the hydraulic cylinders 108, 109. The control unit 213 detects that the pressure exceeds a certain first level (for example 350 bar) via the pressure sensor 229. The control unit 213 then emits a signal to the outlet valve 207 to drain oil to the tank 243 via a first conduit 271. Accordingly, the outlet valve 207 acts like a shock valve by means of software control. The directly controlled shock valve 261 opens when the pressure exceeds a certain second, predetermined level (for example 360 bar) and initiates draining of flow to the tank 243 via a second conduit 273. The electrically controlled outlet valve 207 now has had time to open for a larger drainage flow to the tank 243. The pressure, which is recorded continuously, drops and the electrically controlled outlet valve 207 and the directly controlled shock valve 261 close at specific pressure levels.

The first level can be equal to the second level, but preferably the first level is smaller than the second level. This in order to obtain a substantially simultaneous, or earlier, opening of the control valve relative to the shock valve.

As a supplement or an alternative to the foregoing, the electrically controlled outlet valve 207 is controlled on the basis of the pressure derivative (in order to obtain faster opening of the electrically controlled outlet valve 207). For example, the control valve is controlled to serve as a shock valve as soon as the pressure derivative in the cylinder 108, 109 exceeds a certain level, irrespective of whether the pressure level is low. If an external force initiates a movement of the cylinder, the control valve will initiate its opening procedure before the pressure level reaches the upper limit (for example 350 bar). If the upper limit is not reached, the control valve will still close when the pressure derivative falls short of a certain level.

According to a further variant, the electrically controlled shock valve 207 has a variable opening pressure. Preferably, the pressure level is set depending upon an actual operating condition (such as load-arm position and/or bucket position). The directly controlled shock valve 261 is then set to open only at the maximum pressure level. In certain situations, a large shock resistance is needed, for example when the bucket is pushed into a material pile with maximum propulsion, and in other situations, the shock function can open at a lower pressure. This means that the machine/iron is subjected to less stress.

The opening pressure of the electrically controlled valve 207 is, for example, dependent on the following operating parameters:

Cylinder positions for different functions. For example, when the bucket is pushed with maximum propulsion into the material pile (when the unit is lowered and the bucket is in a level position) an exceptionally high resistance is needed on the piston side of the lift cylinder.

Type of implement. Implements which are not influenced by the propulsion (for example a pallet fork assembly) do not need as high an opening pressure as a bucket.

Type of handling. One handling example is loading timber onto a truck. Another example is bucket handling for loading gravel/rocks. Furthermore, it is conceivable to use the same implement, for example a bucket, for different handling operations. Accordingly, type of handling can be independent of type of implement.

According to one example, the system is adaptive. The control unit can then record how the wheel loader is operated during a certain period of time through detecting operating parameters and concluding which handling operation is performed and/or which implement type is used. Alternatively, or as a supplement, the limit value is determined on the basis of a signal from an operator-controlled element, such as a lever, button, or another control means in the cab.

Machine speed. At high machine speeds, it is safer if the opening pressures of the shock valves are at a higher level.

According to a further variant, the electrically controlled valve 207 has different pressure drops for the same flow rate, wherein the pressure drop is dependent on the following:—the function concerned and/or—the cylinder position. When subjected to shock loading with the load-arm in a high position, it is not desirable that the unit falls to the ground, but is lowered at a controlled speed. With this system all functions and all machine sizes can have the same shock characteristics, that is to say, when the shock function opens, the same degree of resistance can be felt irrespective of the type of machine concerned.

Furthermore, an adaptive shock control on the basis of a pressure level can be utilized. The basic idea is to have as low an opening pressure as possible, with the purpose of "sparing" the machine. The machines which are handled most aggressively are the ones which to a great extent decide the opening levels. Therefore, according to a further variant, an adaptive opening pressure is introduced. Thereby, most of the machines can be at lower levels and the machines which require higher levels will also get such levels. The idea is that the control unit 213 records the extent of shock loading which occurs. If this exceeds a certain level, the opening pressure for the electrically controlled shock valve 207 is temporarily increased within certain limits. The opening pressure can be a function of all or certain of the following: shock loading frequency, shock loading time, shock loading time expressed as a percentage of total machine time (with diesel engine running) and/or shock loading time expressed as a percentage of total active time for the function concerned.

Similar adaptive action can also occur when the electrically controlled shock valve 207 opens at a certain pressure derivative. The pressure derivative limit can be adjusted depending upon how often/much the electrically controlled shock valve 207 opens as a result of the pressure derivative. The same function dependent parameters as described above can be used, but where, as mentioned before, only those cases where the shock loading control occurs as a result of the pressure derivative are taken into consideration.

The invention should not be regarded as limited to the above-described exemplary embodiments, but a number of further variants and modifications are conceivable within the scope of the following claims. In particular, the preferred embodiments can be combined in a number of different ways.

The invention claimed is:

1. Method for automatically limiting a pressure generated during operation in a hydraulic system when needed, the system being adapted to deliver a pressurized hydraulic fluid to at least one actuator arranged to perform a work function by means of an implement of a working machine, wherein the method comprises the steps of:

detecting a pressure in at least one position in the system;

comparing the detected pressure value, or a value associated with the detected pressure value, with a first predetermined limit value;

opening a flow communication between the actuator and a tank via a first conduit if the detected pressure value, or the value associated with the detected pressure value exceeds the predetermined limit value; and detecting an operating parameter which is indicative of a position of the implement and determining the limit value on the basis of the detected operating parameter.

2. Method according to claim 1, wherein the flow communication is opened via a control valve being arranged on the first conduit and having the function to control the supply of the hydraulic fluid to and from, respectively, the actuator with the purpose of performing the work function.

3. Method according to claim 2, comprising the step of opening the control valve via an electrical signal.

4. Method according to claim 1, wherein a first control valve is arranged on a conduit connecting to a first side of the actuator and a second control valve is arranged on a conduit connecting to a second side of the actuator, comprising the step of detecting the pressure on at least one of the actuator sides and opening the control valve to the tank, which is arranged on the at least one of the actuator sides where increased pressure has been generated.

5. Method according to claim 1, further comprising the step of opening a flow communication between the actuator and the tank via a second conduit via a shock valve.

6. Method according to claim 5, wherein the shock valve is passive.

7. Method according to claim 5, wherein the shock valve is spring-loaded.

8. Method according to claim 5, wherein the first and second conduit are connected to the same side of the actuator.

9. Method according to claim 2, comprising opening a flow communication between the actuator and the tank via a second conduit via a shock valve, wherein the control valve drains a larger flow to tank than the shock valve does.

10. Method according to claim 1, further comprising the steps of detecting the pressure when the flow communication between the actuator and the tank via the first conduit has been opened, and closing the flow communication between the actuator and the tank via the fist conduit if the pressure value, or the value associated with the detected pressure value, falls short of a second predetermined limit value being lower than the first limit value.

11. Method according to claim 1, comprising the step of detecting the pressure of the actuator.

12. Method according to claim 1, comprising the step of detecting a level of the pressure in the position in the system, comparing the pressure level with a first predetermined limit value for the pressure level, and opening the flow communication between the actuator and the tank via the first conduit if the pressure level exceeds the predetermined limit value.

13. Method according to claim 1, comprising the step of determining a derivative of the pressure in the position in the system, comparing the pressure derivative with a first predetermined limit value for the pressure derivative, and opening the flow communication between the actuator and the tank via the first conduit if the pressure derivative exceeds the predetermined limit value.

14. Method according to claim 1, comprising the step of determining the limit value on the basis of an actual operating condition.

15. Method according to claim 1, comprising the step of detecting at least one operating parameter and determining the limit value on the basis of the detected operating parameter.

16. Method according to claim 15, comprising the step of detecting the at least one operating parameter repeatedly and determining the limit value based upon how the work function is performed.

17. Method according to claim 1, comprising the steps of controlling a plurality of work functions, including lifting and tilting of an implement.

18. Method according to claim 1, wherein different limit values are associated with at least two of the work functions, wherein the method comprises the step of selecting the limit value which is associated with the work function being performed for the comparison.

19. Method according to claim 1, comprising the steps of controlling the working machine, the working machine comprising the system.

20. Method according to claim 19, comprising the step of detecting an operating parameter which is indicative of the type of implement being actuated via the actuator and determining the limit value on the basis of the detected implement type.

21. Method according to claim 19, comprising the step of detecting an operating parameter which is indicative of the type of handling being performed with the machine and determining the limit value on the basis of the detected type of handling operation.

22. Method according to claim 20, comprising the step of detecting an operating parameter which is indicative of a machine speed and determining the limit value on the basis of the detected machine speed.

23. Method according to claim 1, comprising the step of determining the flow rate to the tank on the basis of the detected pressure.

* * * * *